US005562280A

United States Patent [19]

Niimura et al.

[11] Patent Number: 5,562,280

[45] Date of Patent: Oct. 8, 1996

[54] SHEET CONVEYING APPARATUS HAVING A GUIDE MEMBER TO PREVENT BUCKLING OR CURLING OF A CONVEYED SHEET

[75] Inventors: Takeshi Niimura, Musashino; Noriyoshi Ishikawa, Yokohama; Yoshihiro Ito, Tokyo, all of Japan

[73] Assignee: Canon Kabushiki Kaisha, Tokyo, Japan

[21] Appl. No.: 258,209

[22] Filed: Jun. 10, 1994

[30] Foreign Application Priority Data

Jun. 25, 1993 [JP] Japan ..... 5-155307

[51] Int. Cl.[6] ..... B65H 9/16

[52] U.S. Cl. ..... 271/248; 271/4.1

[58] Field of Search ..... 271/4.1, 248, 249, 271/250, 251, 252

[56] References Cited

U.S. PATENT DOCUMENTS

| | | | |
|---|---|---|---|
| 1,833,027 | 11/1931 | L'enfant | 271/248 |
| 4,179,117 | 12/1979 | Rhodes, Jr. | 271/251 |
| 4,432,541 | 2/1984 | Clark et al. | 271/251 |
| 4,621,801 | 11/1986 | Sanchez | 271/248 X |
| 5,284,333 | 2/1994 | Ishikawa | 271/22 |
| 5,290,021 | 3/1994 | Murooka et al. | 271/9 |
| 5,390,909 | 2/1995 | Herrick, Jr. | 271/248 X |

FOREIGN PATENT DOCUMENTS

| | | | |
|---|---|---|---|
| 0581050 | 2/1994 | European Pat. Off. | 271/251 |
| 0330703 | 12/1993 | Japan | 271/248 |
| 2099797 | 12/1982 | United Kingdom | 271/248 |

*Primary Examiner*—William E. Terrell
*Assistant Examiner*—T. Kelly
*Attorney, Agent, or Firm*—Fitzpatrick, Cella, Harper & Scinto

[57] ABSTRACT

A sheet conveying apparatus for use in an image forming apparatus such as a copying machine has a sheet conveyance path defining member that defines a curved path along which a sheet is conveyed, a conveyor roller for conveying the sheet along the curved path, a reference position regulating member that engages with a reference side edge of the sheet so as to regulate the sheet position in the breadthwise direction of the sheet during conveyance of the sheet along the curved path, and a guide member for restricting the position of the reference side edge of the sheet in the direction of thickness of the sheet pressed onto the position regulating member. The conveyor roller cooperates with a skewed roller which produces a skewing urging force to bring the reference side edge of the sheet into pressure contact with the reference position regulating member. The guide member prevents the reference side edge of the sheet pressed to the reference position regulating member from buckling or curling into a gap between the reference position regulating member and the conveyor roller. The conveyor roller and the skewed roller are engageable only with a side portion of the sheet adjacent to the reference side edge.

34 Claims, 15 Drawing Sheets

SHEET CONVEYING APPARATUS HAVING A GUIDE MEMBER TO PREVENT BUCKLING OR CURLING OF A CONVEYED SHEET

BACKGROUND OF THE INVENTION

1. Field of the Invention

The present invention relates to a sheet conveying apparatus for use in an image forming apparatus such as, for example, a copying machine, printer or a facsimile apparatus, for performing recording on a sheet-type recording medium such as a sheet of paper, an overhead projector transparency, an envelope or the like.

2. Description of the Related Art

FIG. 13 shows an electrophotographic laser beam printer as an example of known image forming apparatuses. In this printer, a sheet-like recording medium is fed and conveyed linearly to achieve a high degree of reliability in the sheet conveying operation. This type of sheet conveyance will be referred to as "straight-type sheet conveying method".

This type of sheet conveying method, however, requires a large space for the installation of the recording apparatus because of the area necessary for the sheet inlet portion to be situated, as well as the area where the sheet outlet portion is to be disposed.

In view of the above-described problem, U-type and S-type sheet conveying systems have been proposed in which, as shown in FIGS. 14 and 15, the paths of conveyance of the sheet is curved in a U or an S-shape, so as to reduce the installation area of the recording apparatus.

A sheet conveying apparatus also has been proposed in which a sheet as a recording medium is pinched only at one end by a conveyor roller and a skewed feeding roller, so that the sheet is fed and conveyed with a reference side edge thereof pressed against and guided by a conveyance reference surface provided in the image forming apparatus without skewing with respect to the direction of the conveyance despite the presence of the skewing bias applied thereto. This type of conveying method is generally referred to as "single-side skewed sheet conveying method".

This type of conveying method, however, suffers from a problem such as buckling at the reference side edge or inferior precision of the conveyance, due to the fact that the sheet is generally not still.

SUMMARY OF THE INVENTION

In view of the problems described above, an object of the present invention is to provide a simple and reliable sheet conveying apparatus which contributes to reduction in the size of the image forming apparatus, as well as to improvement in the output image quality and reduction in cost.

According to one aspect, the present invention relates to a sheet conveying apparatus comprising a sheet conveyance path defining member that defines a curved path of conveyance of a sheet; a reference position regulating member for regulating the lateral position of a sheet that is conveyed along the curved conveyance path; conveying means for conveying a sheet along the curved conveyance path while urging he sheet in a direction to keep a side edge of the sheet in contact with said reference position regulating member; and a guide member that restricts the position of a side edge of a sheet in a direction of the thickness of the sheet while the sheet is conveyed along the curved conveyance path.

According to another aspect, the present invention relates to a sheet conveying apparatus comprising a rotary conveyor member for conveying a sheet; a conveyance path defining member disposed opposite to an outer peripheral surface of said rotary conveyor member so as to define therebetween a curved conveyance path of a sheet conveyed along the outer peripheral surface of said rotary conveyor member; a reference position regulating member for regulating the lateral position of a sheet when the sheet is conveyed by said rotary conveyor member; a skewed rotary member in the curved conveyance path for urging a sheet conveyed by said rotary conveyor member in a direction such that a side edge of the sheet is pressed against said reference portion regulating member; and a guide member that restricts movement of a side edge of a sheet in a direction of sheet thickness as the sheet is pressed against said reference position regulating member.

According to yet another aspect, the present invention relates to a sheet conveying apparatus comprising sheet stack storage means for storing a stack of sheets; sheet feeding means for feeding sheets one by one from the stack in said sheet stack storage means; a rotary conveyor member, a conveyance path defining member, a reference position regulating member, a skewed rotary member, and a guide member as described hereinabove. The sheet feeding means, the rotary conveyor member and the skewed rotary member each pressing against only the lateral edge of the sheet regulated by said reference position regulating member.

According to yet another aspect, the present invention relates to an image forming apparatus comprising image forming means for forming a image on a sheet that is being conveyed by conveying means as described hereinabove, as well as a sheet conveyance path defining member, a reference position regulating member, and a guide member, also as described hereinabove.

According to yet another aspect, the present invention relates to an image forming apparatus comprising image forming means, a rotary conveyor member, a conveyance path defining member, a reference position regulating member, a skewed rotary member, and a guide member, all as described hereinabove.

According to yet another aspect, the present invention relates to an image forming apparatus comprising image forming means, sheet stack storage means, sheet feeding means, a rotary conveyor member, a conveyance path defining member, a reference position regulating member, a skewed rotary member, and a guide member, all as described hereinbefore.

DESCRIPTION OF THE PREFERRED EMBODIMENTS

Figure 1:
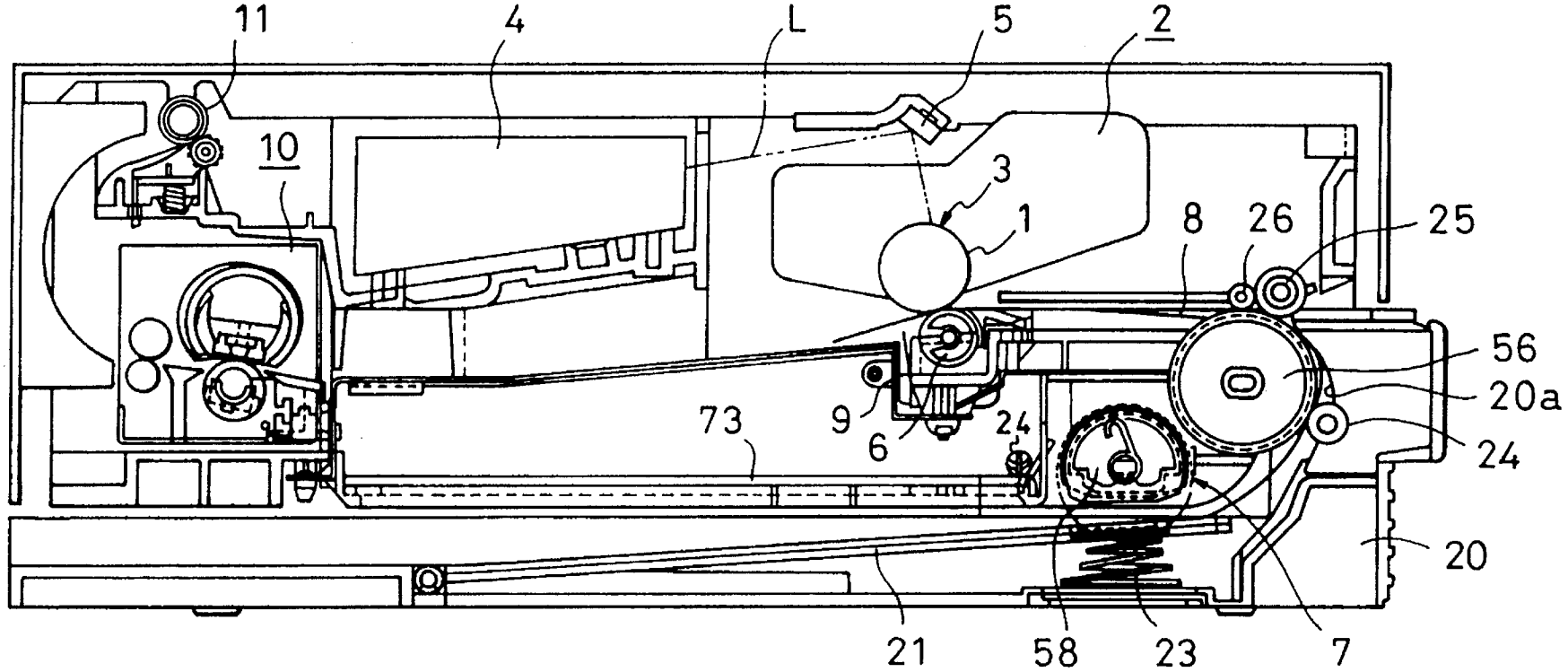
FIG. 1 is a sectional view of an embodiment of the present invention.
Figure 2:
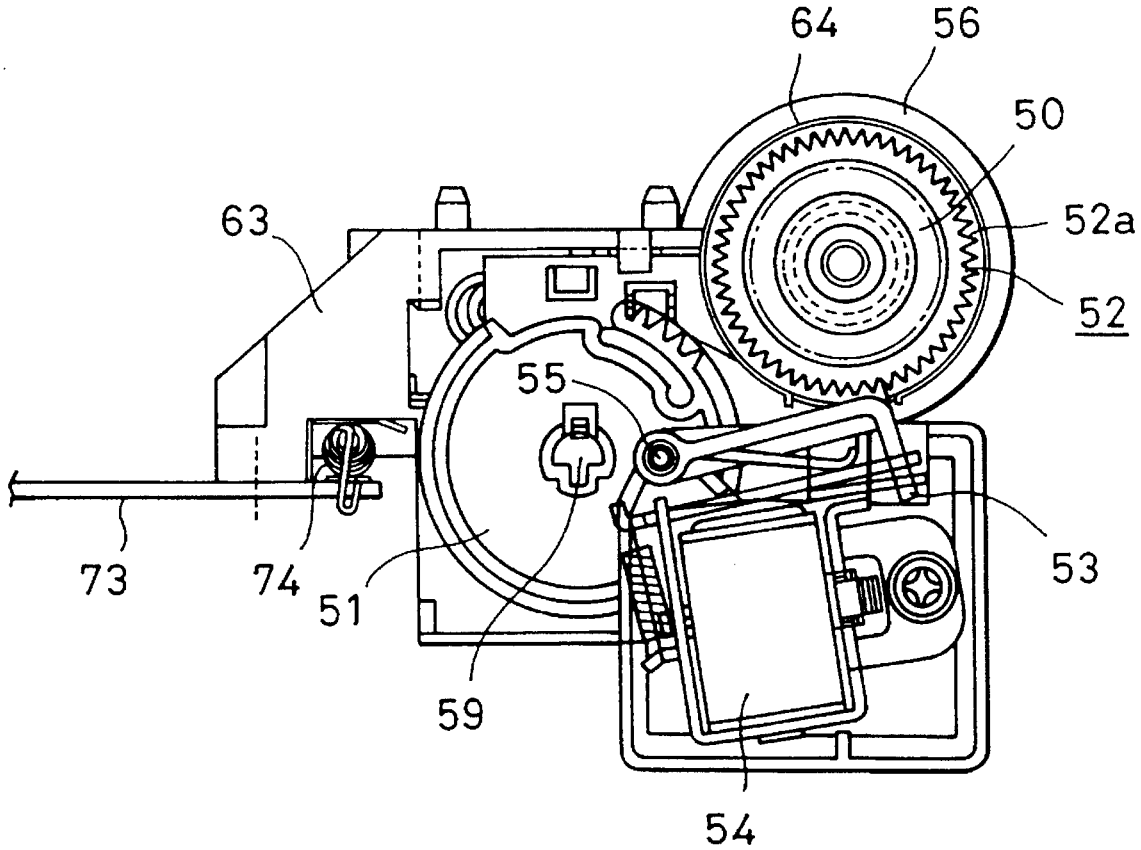
FIG. 2 is an elevational view of a sheet feed unit incorporated in the embodiment.
Figure 3:
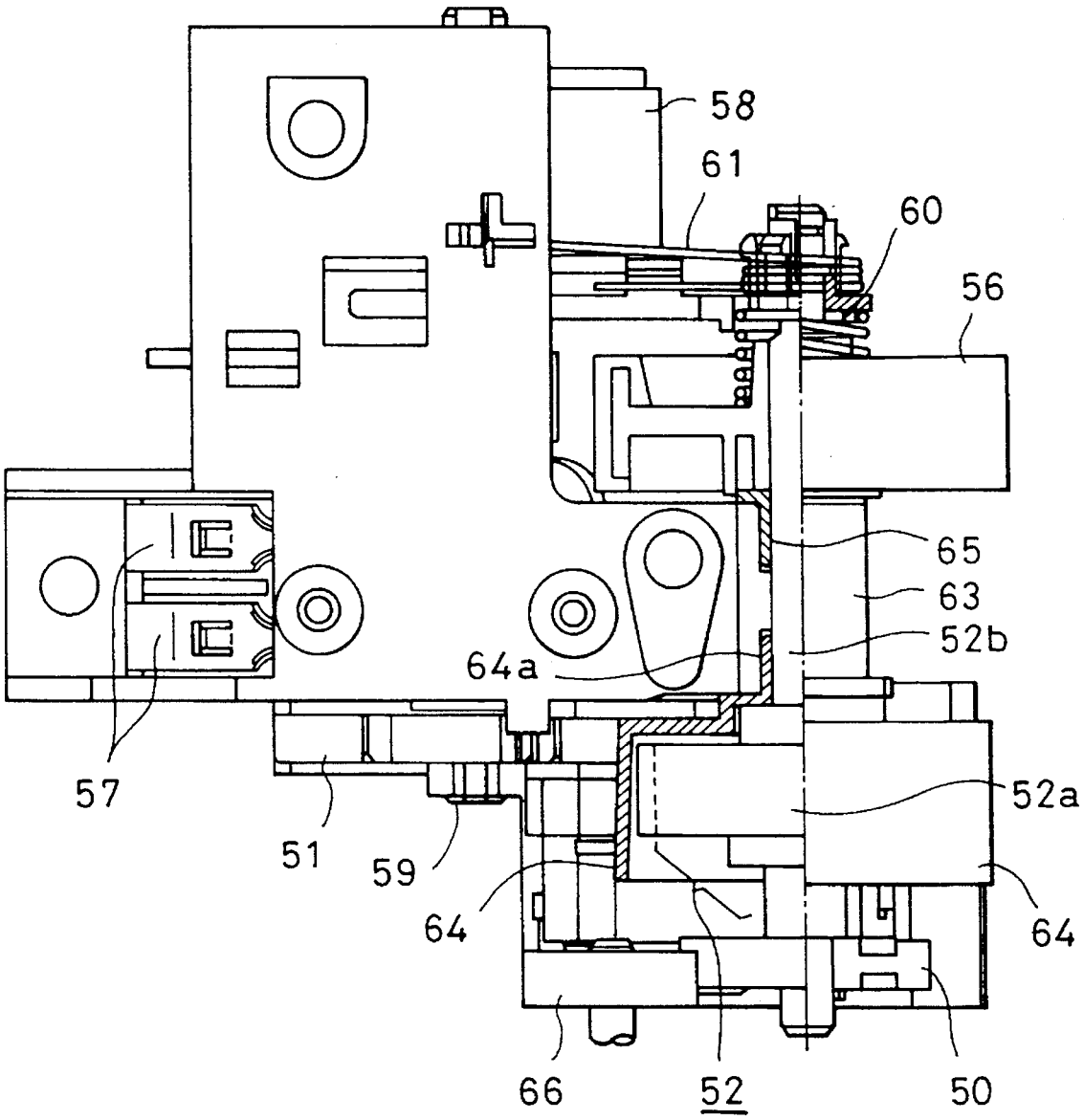
FIG. 3 is a plan view of the sheet feed unit shown in FIG. 2.
Figure 4:
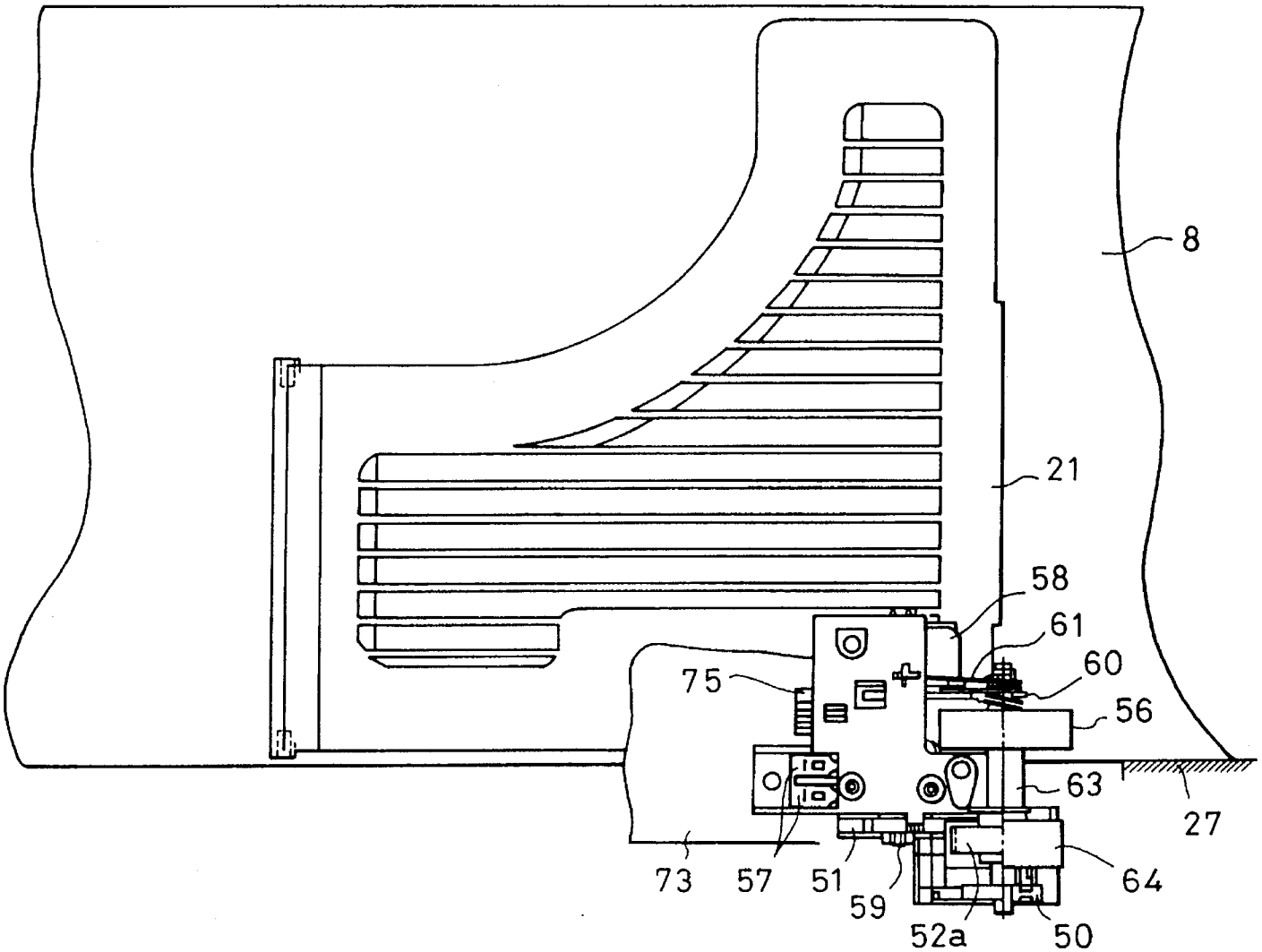
FIG. 4 is an enlarged plan view of the sheet feed unit shown in FIG. 3.

FIG. 1 shows an embodiment of the sheet conveying apparatus of the present invention applied to an electrophotographic laser beam printer (LBP) of the type in which a photosensitive member is scanned by and exposed to a laser beam and an image formed on the photosensitive member is transferred to a recording sheet.

More specifically, the laser beam printer has a drum-type electrophotographic photosensitive member 1 which is disposed in a process cartridge 2 and which is rotationally driven at a predetermined speed about the axis of its supporting shafts. The photosensitive member 1 will be referred to simply as the "drum" hereinafter. The drum 1 has a cylindrical base and a photosensitive layer formed on the cylindrical base mainly from an organic or inorganic photoconductive material.

The photosensitive peripheral surface of the drum is uniformly charged to a predetermined positive or negative potential by a primary charger (not shown) in the process cartridge during the rotation of the drum 1. The charged drum surface is then brought to an exposure section 3 where it is scanned with a laser beam emitted from a laser scanner 4, whereby an electrostatic latent image of the image information to be recorded is formed progressively on the photosensitive outer surface of the drum 1. Numeral 5 designates a laser beam deflecting mirror which deflects a laser beam L emitted from the laser scanner 4 to the exposure section 3, thereby causing the beam to scan the photosensitive outer peripheral surface of the drum 1.

The portion of the drum surface having the latent image formed thereon is then brought to a region where a developing unit (not shown) disposed in the process cartridge is located, so that the latent image is changed into a visible toner image by means of a developing agent or toner supplied by the developing unit.

The portion of the drum surface carrying the toner image is then made to pass through a region where a transfer roller 6 is disposed, so that the toner image is progressively transferred to a surface of a transfer member, e.g., a recording medium, which is fed by a sheet feeding mechanism 7 in one by one fashion into the nip between the transfer roller 6 and the drum 1. The transfer of the toner image from the surface of the drum 1 to the surface of the recording paper 8 as the transfer member is effected by the transfer roller 6 which is disposed on the back side of the recording paper 8 and which electrostatically charges the latter in a polarity reverse to that of the toner image.

The recording paper 8 which has passed the transfer roller 6 is then brought to a region downstream of the transfer roller 6, as viewed in the drum rotation direction where separation charge-removing styli 9 are disposed. The styli 9 are charged in reverse polarity to that of the transfer roller 6, so that the electrostatic charges imparted by the transfer roller 6 are removed so as to allow separation of the recording paper 8 from the surface of the drum 1. The recording paper 8 thus separated is then introduced into a fixing device 10 so that the toner image which has been transferred to the recording paper 8 is permanently fixed to the recording paper 8. The recording paper 8, now having a transferred image fixed thereto, is brought into the nip between a pair of sheet ejection rollers 11 so as to be ejected to an ejection tray (not shown).

The portion of the surface of the drum 1, after the transfer of the toner image therefrom, is moved to a region where a cleaning device (not shown) incorporated into a process cartridge is disposed, so that toner which did not contribute to image formation, and other residual matters, are removed from the drum surface, whereby the drum surface is cleaned to be subjected to repeated use for image formation.

Critical portions of the present invention will be described with reference to FIGS. 2 to 7.

The main part of the recording apparatus has a main motor (not shown) which is drivingly connected to a sheet conveyor roller gear 50 and also to a sheet feed roller driving intermittent gear 51 through gear trains which are not shown. The gear engageable with the sheet feed roller driving intermittent gear 51 is so arranged that its engaging portion is in phase with the non-toothed portion of the intermittent gear 51. The sheet conveyor roller gear 50 is driven through a sheet conveyor roller drive gear 66.

A sheet feed roller solenoid (not shown) has a portion engaging with a sheet feed roller stopper 50*a* so as to prevent the sheet conveyor roller gear 50 from rotating.

The sheet conveying apparatus of this embodiment has a clutch 52 incorporating a planetary gear train which is known per se. The planetary gear train includes a sun gear 52*a*. A latch pawl 53 is pivotally driven by a solenoid 54 about the axis of a shaft 55 into and out of engagement with the sun gear 52*a* so as to allow the sun gear 52*a* to rotate intermittently, thus controlling the transmission of the torque to a sheet conveyor roller 56 which is provided on the output shaft of the clutch 52.

Deposition of matter such paper dust between the latch pawl 53 and the sun gear 52*a* may causes a problem such that the friction between the pawl 53 and the teeth of the sun gear 52*a* becomes too large to enable the pawl 53 to be disengaged from the teeth of the sun gear 52*a* by the force of the solenoid 54. Deposition of paper dust or the like on the teeth of the sun gear 52*a* also poses a problem in that the latch pawl 53 cannot be brought into engagement with the teeth of the sun gear 52*a* even when the sun gear 52*a* has been correctly rotated to a position where it has to be stopped.

In order to avoid these problems, the illustrated embodiment employs a clutch cover 64 which prevents paper dust of the recording paper from coming into the region between the sun gear 52*a* and the latch pawl 53. A main frame 70 also has a wall (not shown) for preventing invasion by paper dust and other foreign matter. The clutch cover 64 also serves as a bearing 64*a* for an output shaft 52*b* so that it can be disposed coaxially with and in the vicinity of the sun gear 52*a*, thus providing an effective means for preventing invasion by paper dust and other foreign matter.

Reference numeral 65 designates an output shaft bearing which cooperates with the clutch cover 64 in holding the output shaft 52*b* at a predetermined position.

Lead wires led from the solenoid 54 are crimped to solenoid terminals 57.

A sheet feed roller 58 is carried by a sheet feed roller shaft 59 which is drivingly connected to the sheet feed roller gear 51. In operation, the sheet feed roller 58 separates a sheet of recording paper 8 from a sheet stack on a sheet feed cassette 20 and feeds the same in one-by-one fashion.

Figure 5:
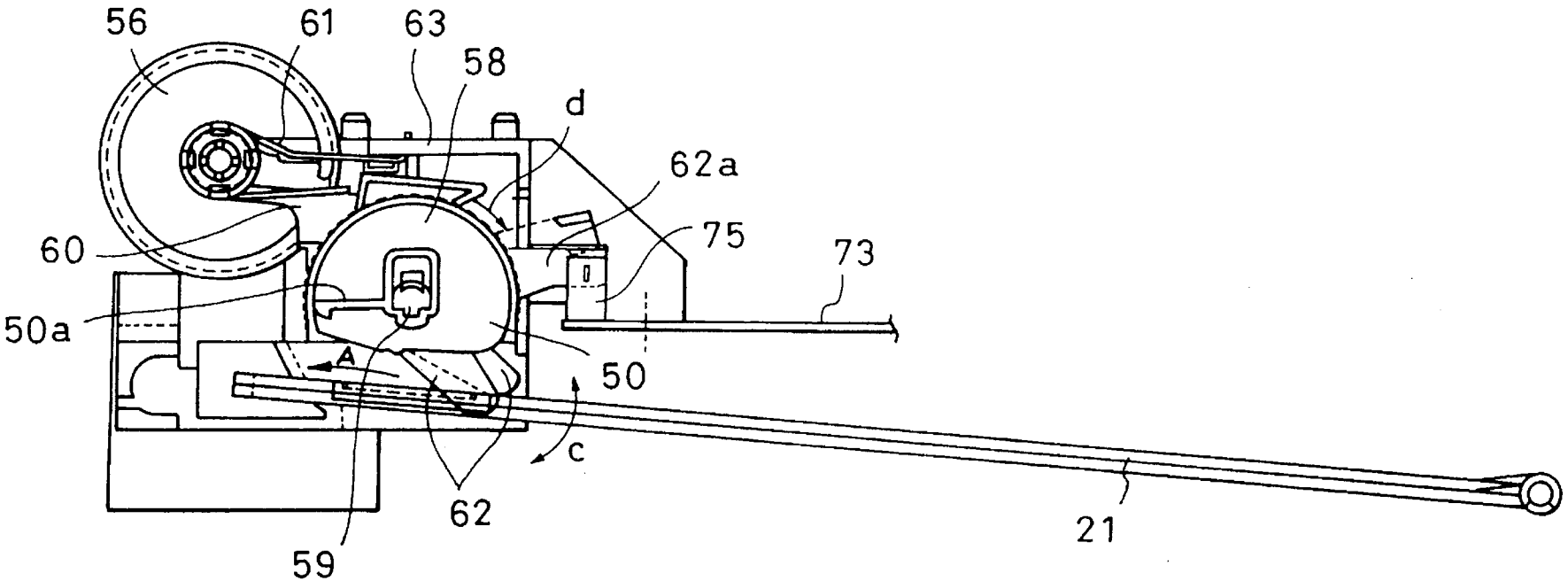
FIG. 5 is a side elevational view of the sheet feed unit.
Figure 6:
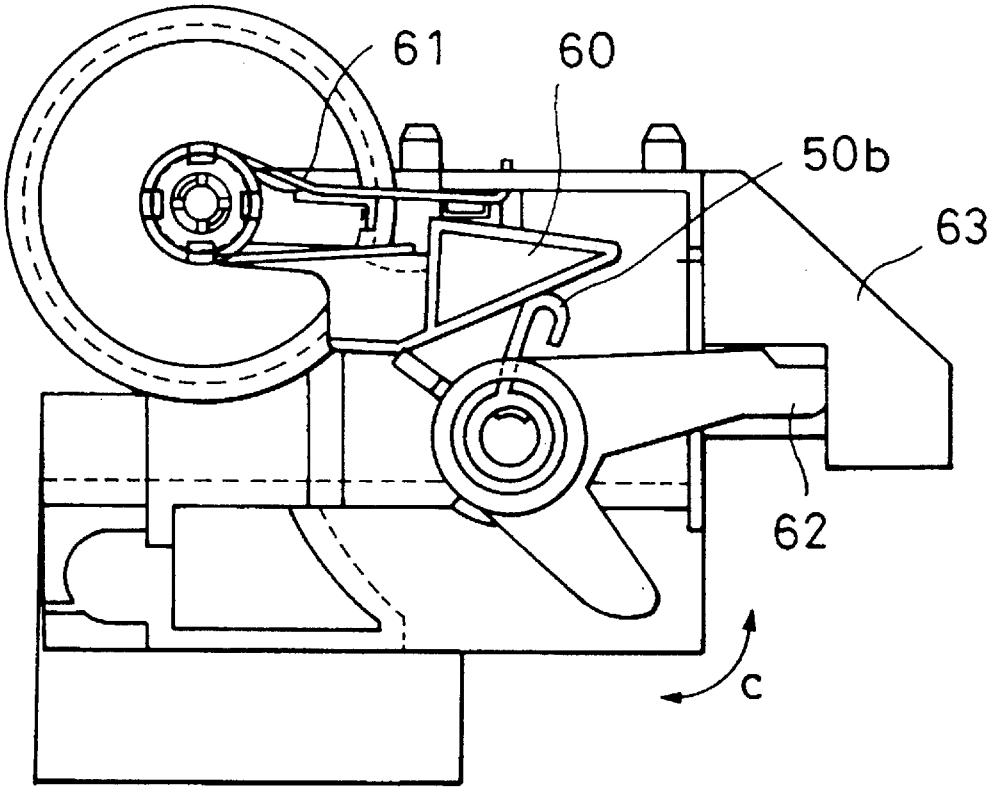
FIG. 6 is an illustration of positions of a sheet feed roller lever and a sheet feed roller cam in the sheet feed unit relative to each other.

A sheet feed roller lever 60 is rotatable about the axis of the shaft of the clutch 52 and cooperates with a sheet feed roller spring 61 to apply a pressing force onto a cam portion 50*b* formed on the sheet feed roller 58, thereby rotationally urging the sheet feed roller 58 in the direction of the arrow "d" (se FIG. 5).

A sheet sensor arm 62 is pivotally movable in the directions of the arrows "c" (see FIG. 5), depending on whether recording sheet is present or absent on an inner plate 21 of the sheet feed cassette 20.

The above-described components are mounted on a sheet feeder frame 63. The sheet sensor arm 62 is pivotally carried by a boss portion of the sheet feeder frame 63. The sheet conveyor roller 56 and the sheet feed roller 58 are arranged to contact only the side end of the recording paper 8 adjacent to the reference guide 27, and the sheet feeder frame 63 as a unit carrying these rollers 56, 58 is secured to one side of the apparatus.

A propelling feeding force is applied by the sheet feed roller 58 only to the uppermost recording paper sheet 8 of the sheet stack carried by the sheet feed cassette 20. The uppermost recording paper sheet 8 is then separated by a separator claw 22 and is fed in the direction "A". The inner plate 21 and the pressing spring 23 (see FIG. 1) cooperate with each other to develop a predetermined contact pressure between the recording paper sheet 8 and the sheet feed roller 58.

The separated recording paper sheet 8 is fed along a conveyance path defining guide 20*a* of the sheet feed cassette 20 into the nip between a first skewed conveyor roller 24 and the sheet conveyor roller 56, so as to be conveyed in synchronization with the rotation speed of the sheet conveyor roller 56 driven by the driving source which is not shown. The recording paper sheet 8 is further conveyed through the nips between the sheet conveyor roller 56 and second and third skewed conveyor rollers 25, 26 into the nip between the drum 1 and the transfer roller 6.

In the illustrated embodiment, the first, second and third skewed conveyor rollers 24, 25 and 26 are arranged to apply skewed conveyance forces at angles of $\theta_1=1°$, $\theta_2=4°$ and $\theta_3=4°$, and are pressed by pressing mechanisms (not shown) against the sheet conveyor roller 56 at pressures of 400 g, 400 g and 300 g, respectively, so as to obliquely urge the recording paper sheet 8 towards the reference guide 27 in the main part of the apparatus, the reference guide 27 regulating the lateral position of the recording paper sheet 8. The sheet feed roller 58, separator claw 22, sheet conveyor roller 56, and the first to third skewed conveyor rollers 24 to 26 are all arranged to contact only the side end region of the recording paper sheet 8 adjacent to the reference guide 27 provided on the main part of the apparatus. Thus, the components forming the conveyor apparatus are arranged in a compact manner along one side edge of the recording paper sheet 8. A description will now be given of the positions of other components relative to the sheet feeder frame 63.

All of the parts are assembled on a main frame 70. More specifically, the main frame 70 carries a main motor 71 which is a driving power source for driving all of the driven components such as the sheet conveyor roller 56, sheet feed roller 58, drum 1, fixing device 10 and the sheet ejection rollers 11 through gear trains, which also are mounted on the main frame 70.

Figure 7:
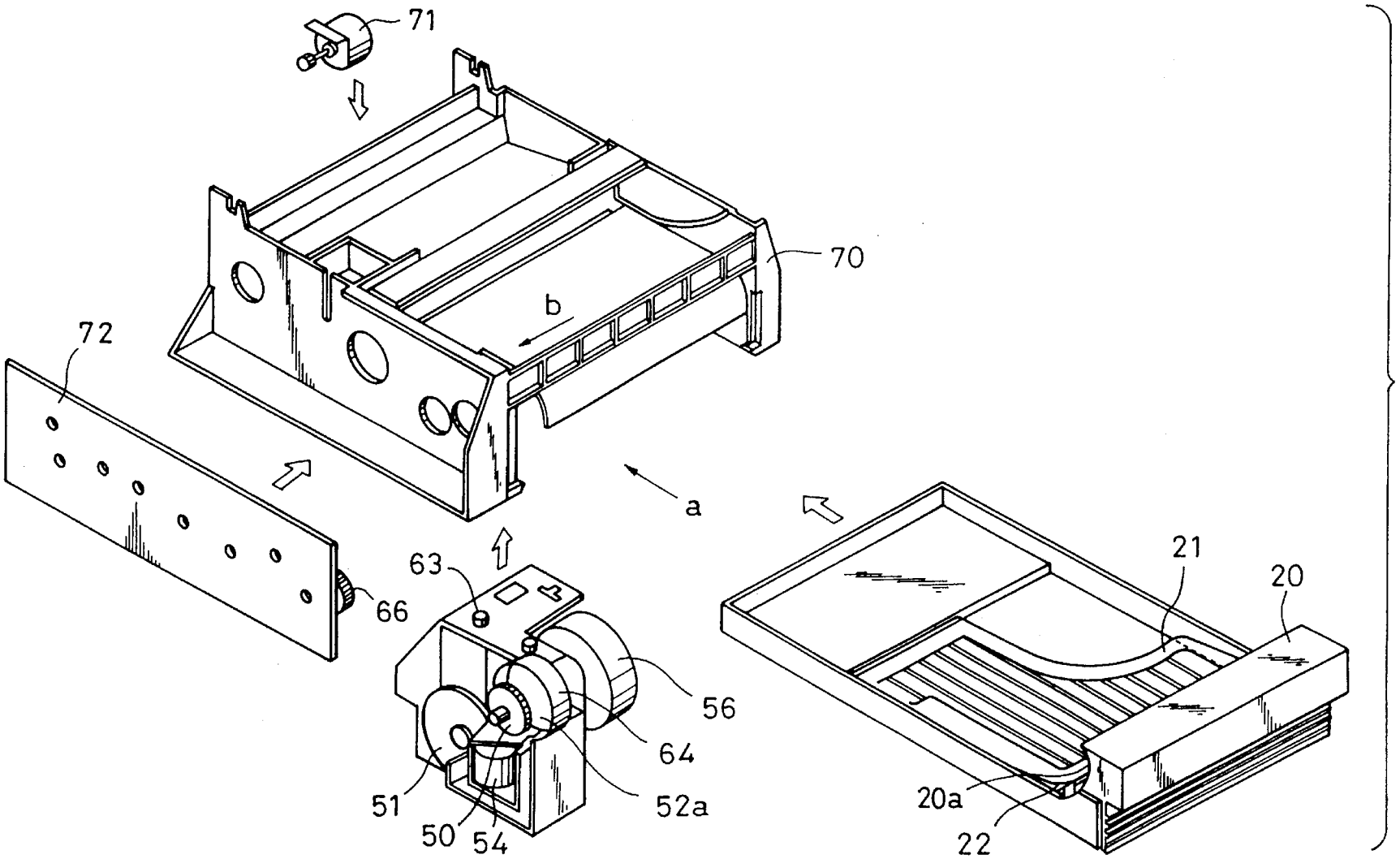
FIG. 7 is an exploded view of the recording apparatus.

The sheet feeder frame 63 is mounted on the main frame 70 by being moved in the direction of an arrow shown in FIG. 7. This mounting movement automatically achieves engagement with predetermined gears of a driving unit 72, as well as an electrical connection between the solenoid terminals 57 and spring contacts 74 on a main circuit board 73 (see FIG. 2) which conducts electrical control of the whole recording apparatus. At the same time, the sheet sensor arm 62 is brought into a slit in an optical sheet sensor 75 which is mounted on the main circuit board 73, as a result of the mounting of the sheet feeder frame 63 onto the main frame 70.

As will be seen from FIG. 5, the arrangement is such that flag portion 62*a* of the sheet sensor arm 62 interrupts the path of light in the optical sheet sensor 75 when there is no recording sheet, whereas, when a sheet or sheets are present on the inner plate 21 of the sheet feed cassette 20, the flag portion 62*a* of the sheet sensor arm 62 is positioned out of the path of the light in the optical sheet sensor 75.

Figure 8:
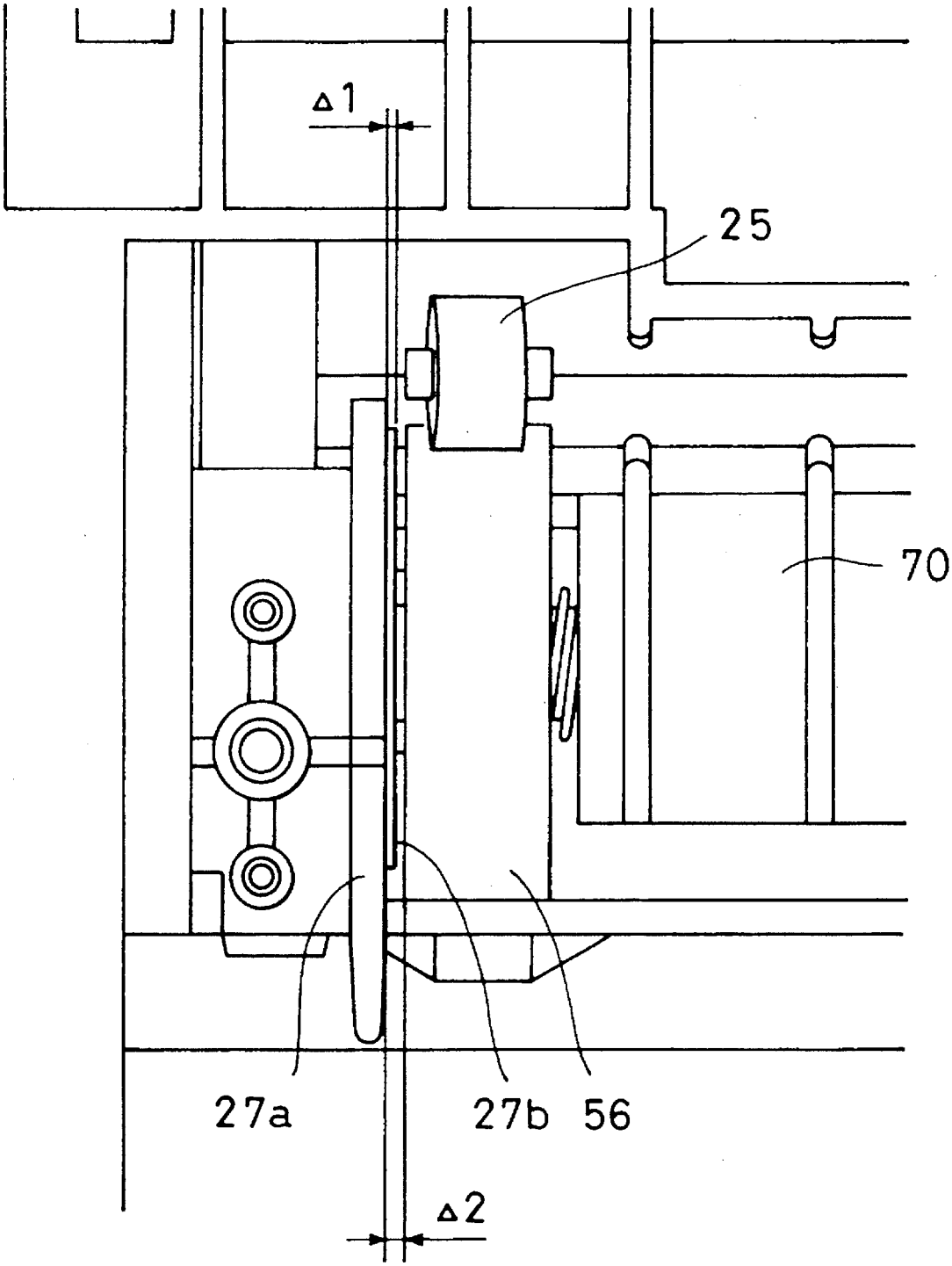
FIG. 8 is a detailed illustration of a conveyance reference surface.
Figure 9:
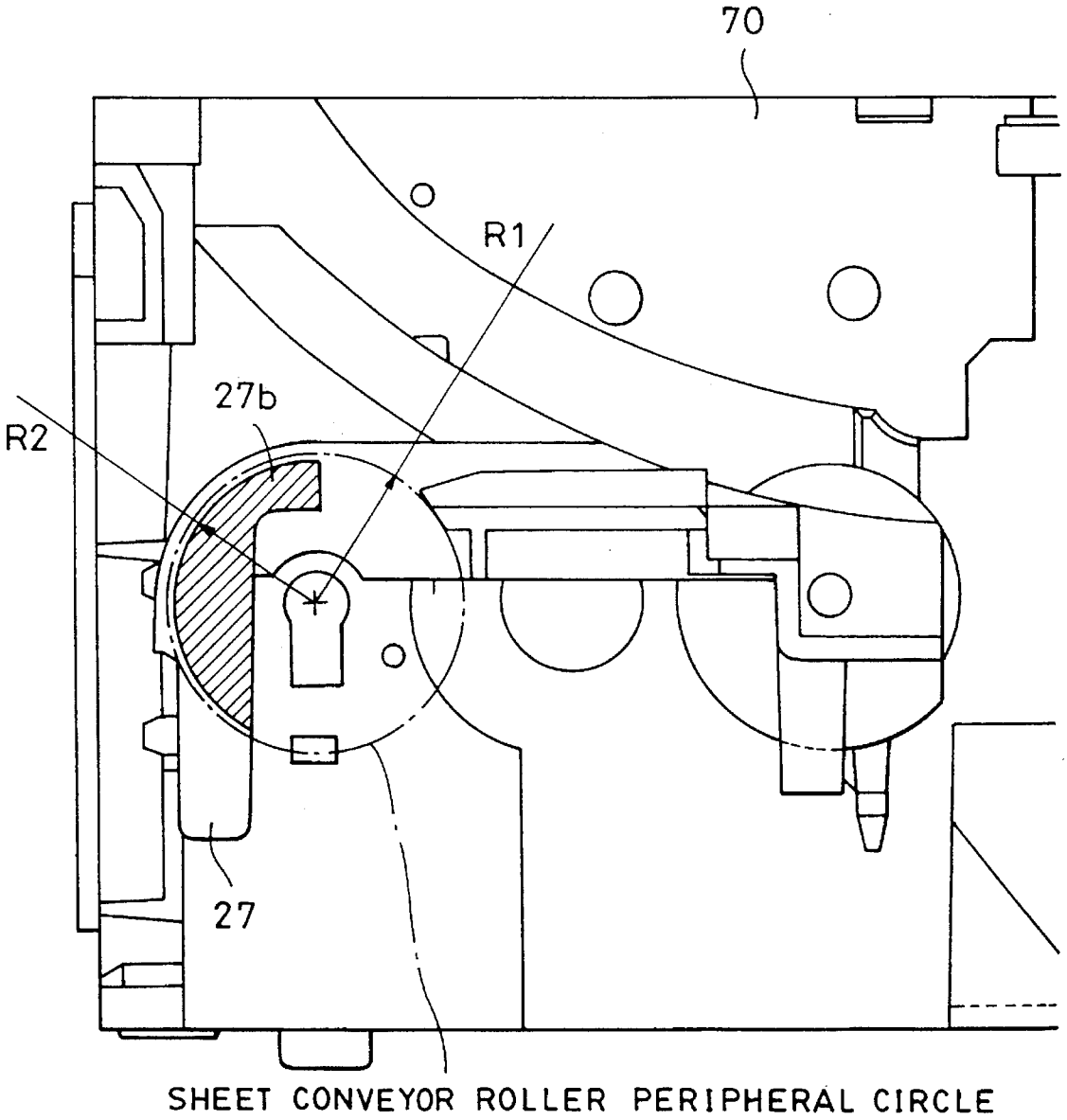
FIG. 9 is a detailed illustration of the conveyance reference surface.

A description will now be given of a conveyance reference surface (reference guide) which provides a guide for one side edge of the recording sheet so as to serve as a conveyance reference, with specific reference to FIGS. 8 and 9. FIG. 8 is a view in the direction of arrow "a" in FIG. 7, while FIG. 9 is a view in the direction of arrow "b" in FIG. 7.

The reference guide 27 is formed on a part of the main frame 70. The reference side portion of the recording paper sheet 8 is made to pass through nips between the sheet conveyor roller 56 and the successive skewed conveyor rollers 24, 25 and 26, so that the recording paper sheet 8 is conveyed on and along the outer periphery of the sheet conveyor roller 56.

Figure 10:
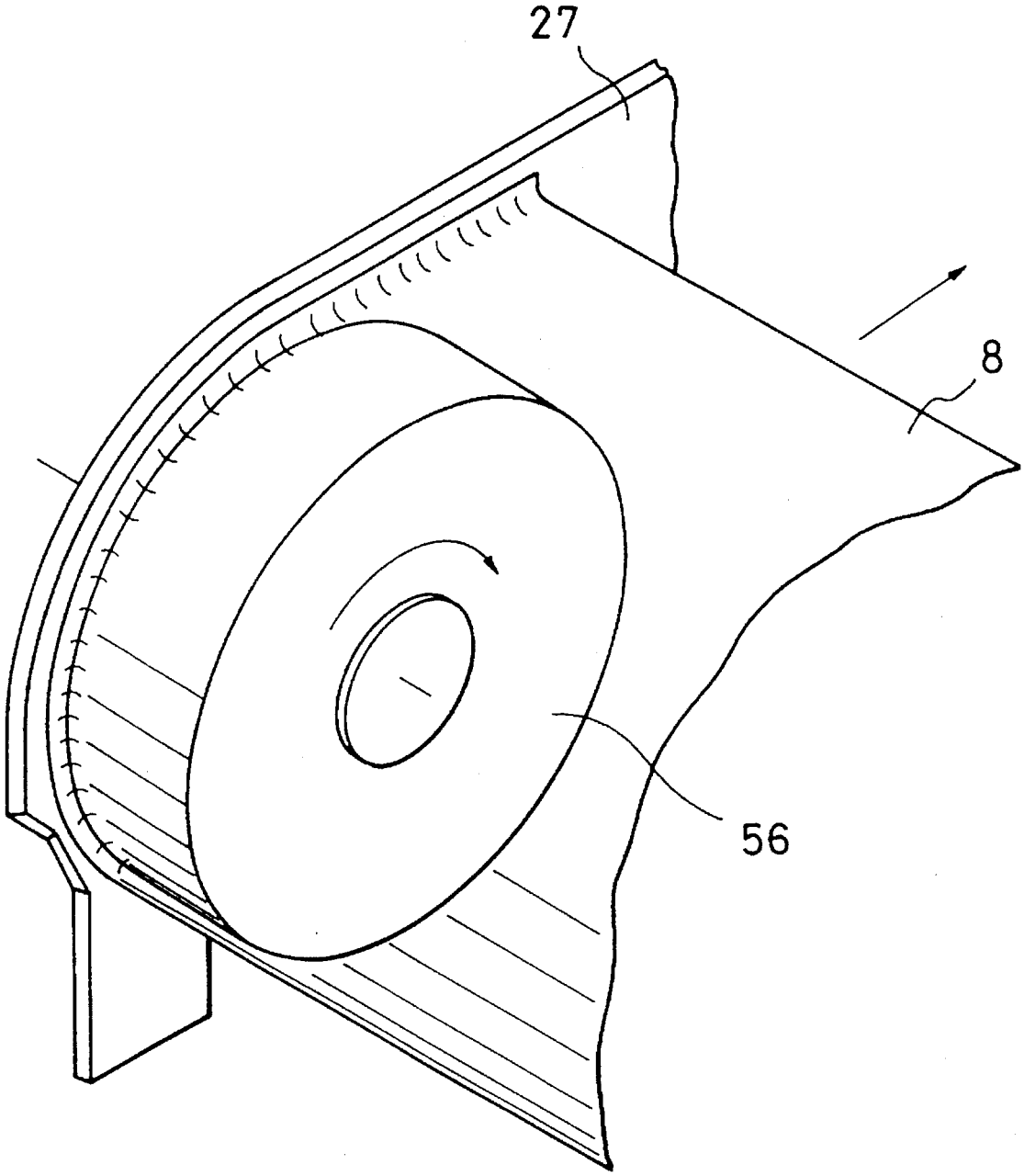
FIG. 10 is an illustration of state of buckling and curling of a recording sheet.
Figure 11:
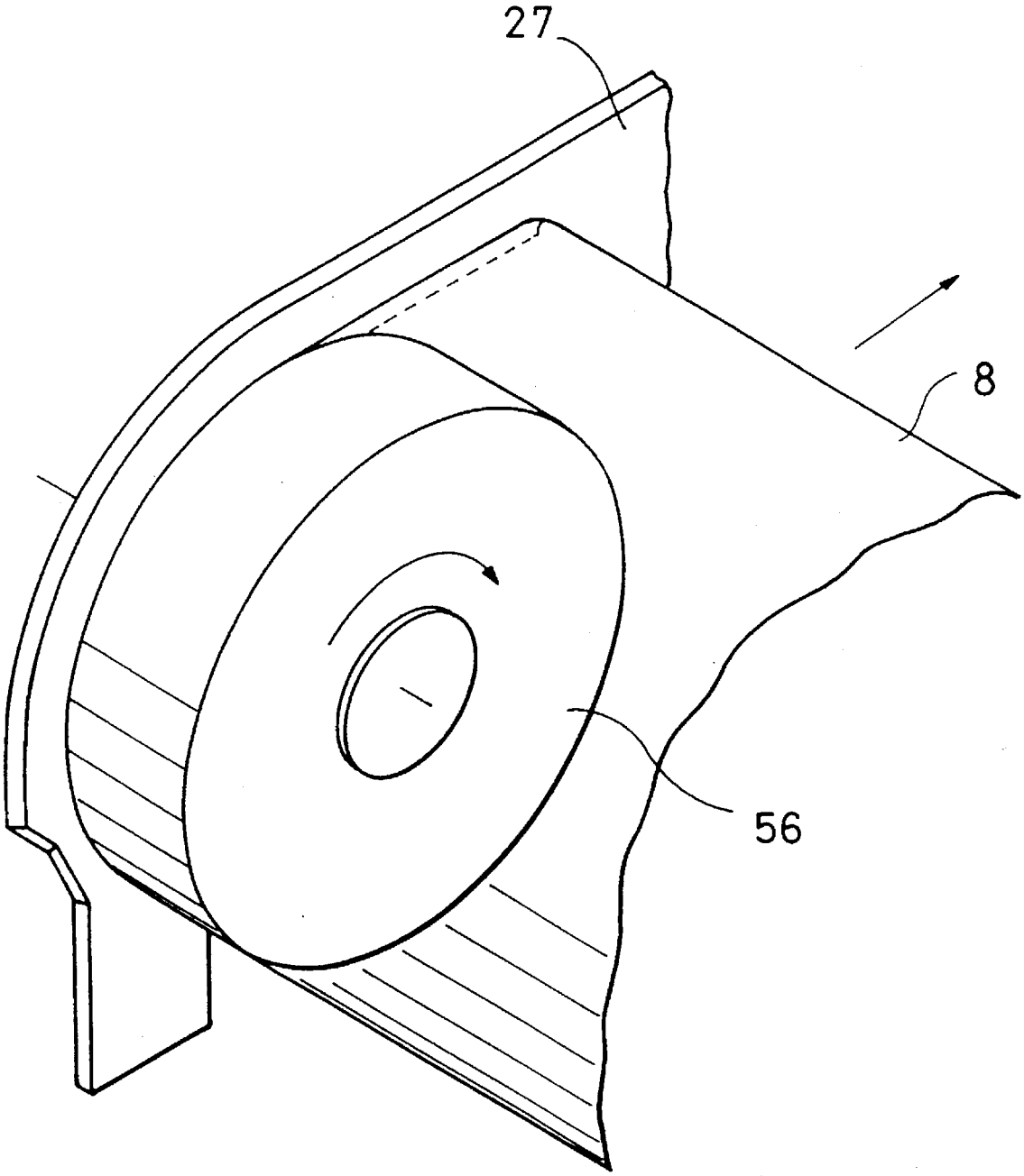
FIG. 11 is an illustration of another state of buckling and curling of the recording sheet.

Since the recording paper sheet 8 is urged into contact with the reference guide 27, the reference side edge portion of the recording paper sheet tends to buckle or curl. In most cases, the buckling or curling occurs such that the reference side edge is forced into a gap $\Delta 2$ (see FIG. 8) between the reference guide 27 and the adjacent axial end surface of the sheet conveyor roller 56 as shown in FIG. 11, rather than being buckled or curled radially outward as shown in FIG. 10.

In the illustrated embodiment, therefore, the reference guide 27 includes, as shown in FIG. 8, a reference guide member 27*a* having a stepped portion 27*b* with a circular peripheral surface of radius R2 slightly smaller than radius R1 of the sheet conveyor roller 56. The reference guide member 27*a* is disposed such that the circular peripheral surface of the step portion 27*b* is concentric with the sheet conveyor roller 56. For instance, when the radius R1 of the sheet conveyor roller 56 is 19 mm, the radius R2 of curvature of the step portion 27*b* is determined to be 18.2 mm and the step height $\Delta 1$ (see FIG. 8) of the step portion 27*b* is determined to be 0.7 mm. The reference side edge of the recording paper sheet 8 which is being conveyed along the reference guide member 27*a* is prevented from buckling or curling into the gap Δ2 between the circular reference guide and the sheet conveyor roller 56, since the reference side edge abuts the outer peripheral surface of the step portion 27*b*. It is thus possible to prevent buckling or curling of the reference side edge of the recording paper sheet 8.

The reference guide member 27*a* may be fixed to the shaft of the sheet conveyor roller 56 so as to rotate as a unit with the sheet conveyor roller 56, or may be fixed to a stationary part of the apparatus so as to be kept stationary. The step portion 27*b* may be formed integrally with the reference guide member 27*a* or may be formed separately from the reference guide member 27*a* and then fixed to the latter.

Figure 12:
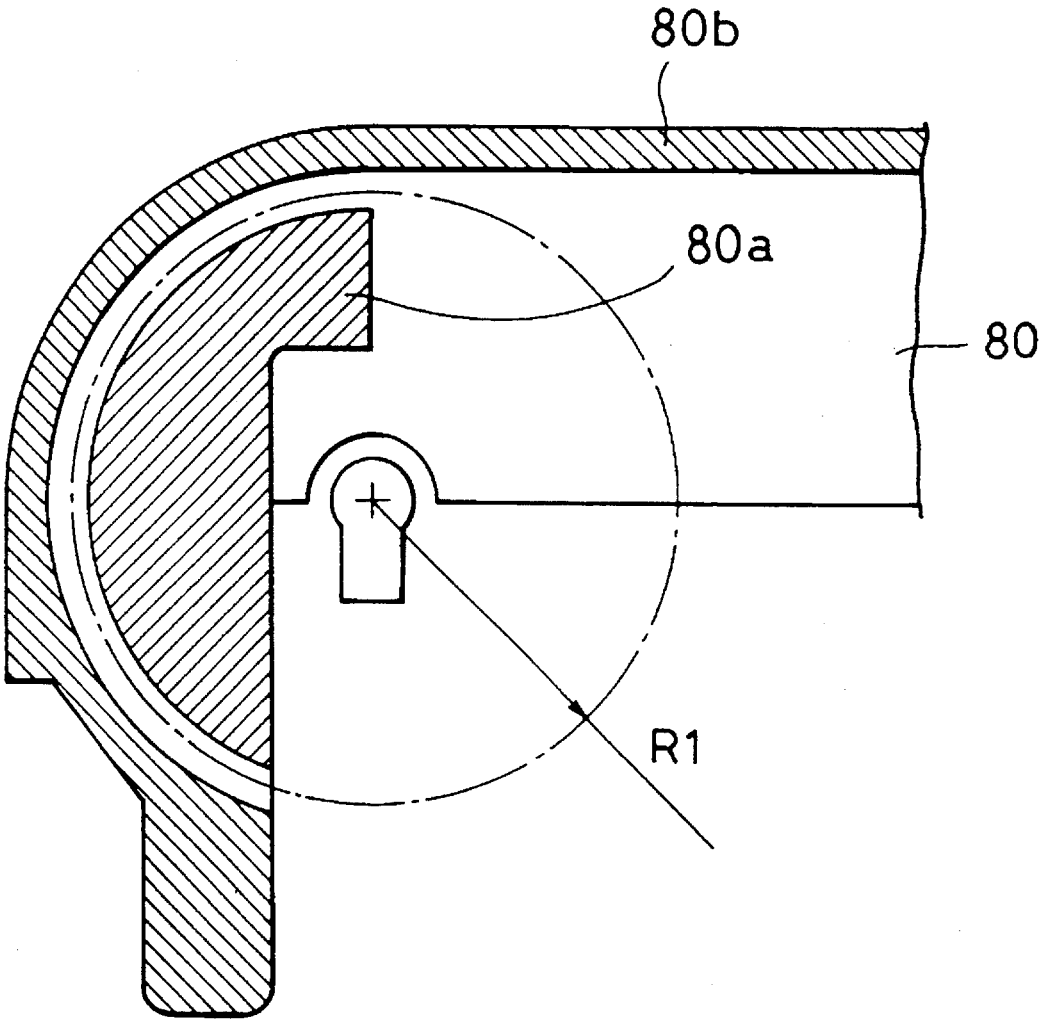
FIG. 12 is an illustration of a modification of the embodiment.
Figure 13:
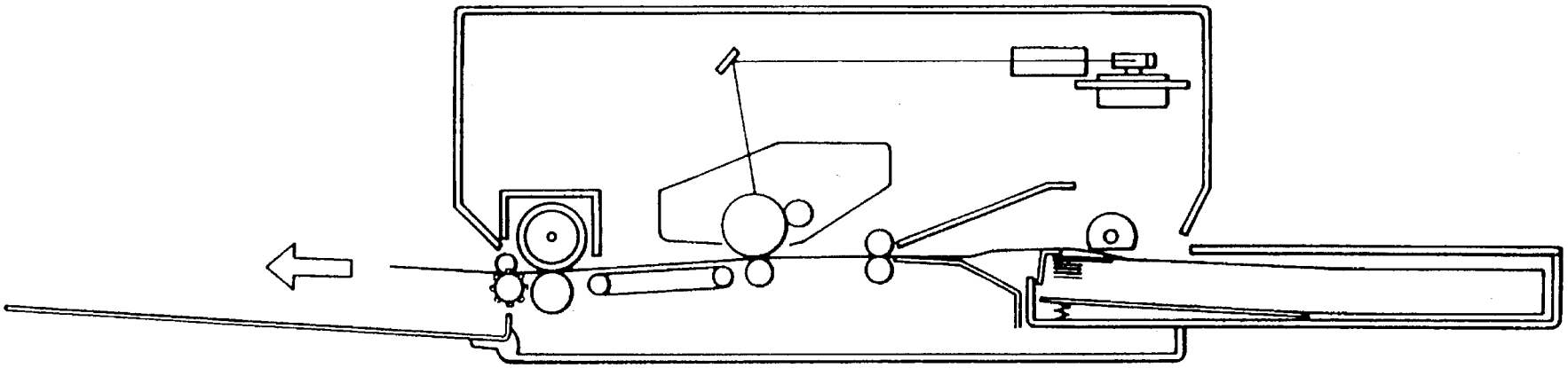
FIG. 13 PRIOR ART
FIG. 13 is a schematic illustration of a known image forming apparatus illustrative of a straight-type sheet conveying method.
Figure 14:
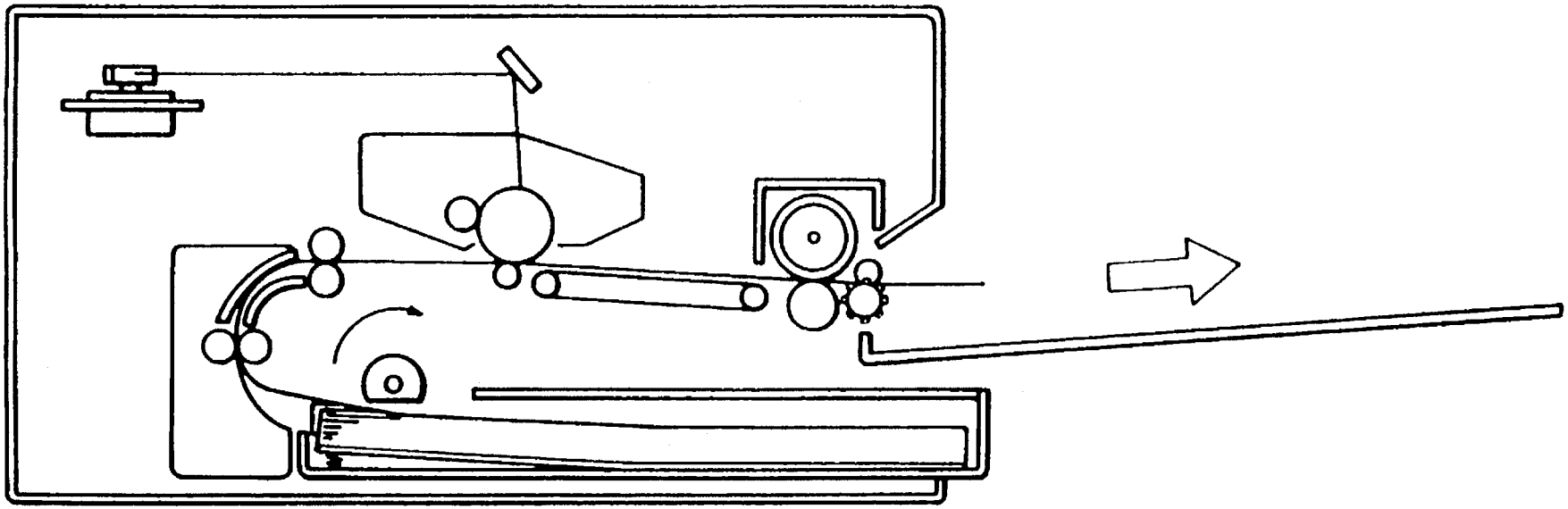
FIG. 14 PRIOR ART
FIG. 14 is a schematic illustration of another known image forming apparatus having a U-shaped path of sheet conveyance.
Figure 15:
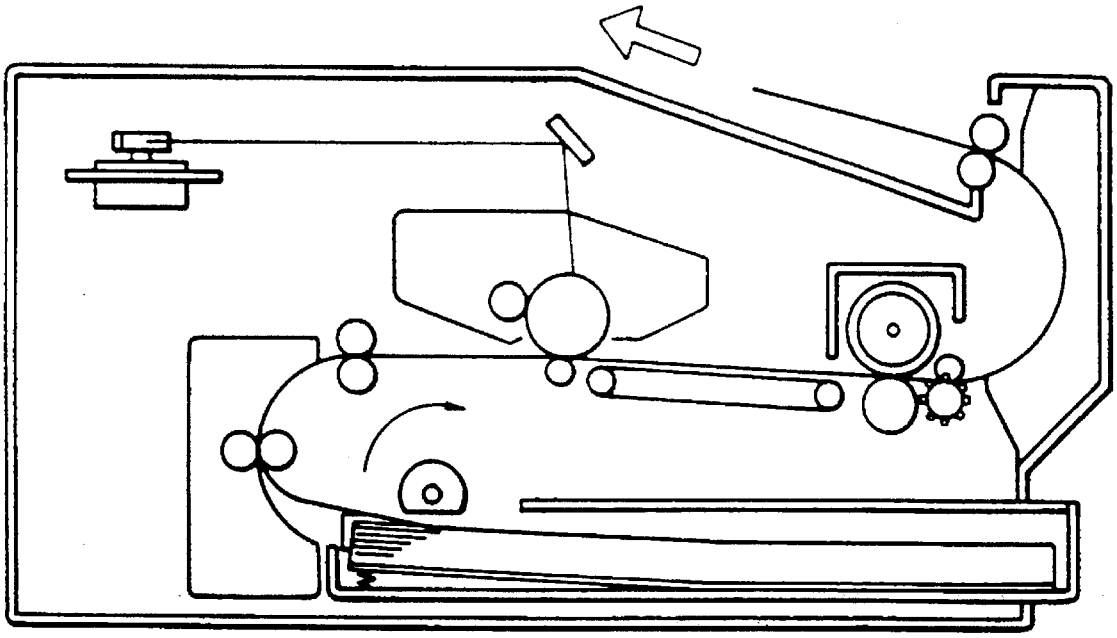
FIG. 15 PRIOR ART
FIG. 15 is a schematic illustration of still another known image forming apparatus having an S-shaped path of sheet conveyance.

FIG. 12 shows another embodiment in which reference guide 80 has reference guide members 80*a*, 80*b* having step portions of the step height Δ1 are provided both at the radially inner and outer sides of the circular path of the reference side edge of the recording paper sheet 8 determined by the peripheral surface of the sheet conveyor roller 56.

As will be understood from the foregoing description, the present invention offers an advantage in that the recording paper sheet can be fed smoothly and accurately without buckling or curling at the reference side edge thereof, even when the skewing biasing force with which the sheet is pressed against the reference guide is increased and even when the recording paper sheet exhibits small rigidity at its side edge.

Although the invention has been described through its specific forms, it is to be understood that the described embodiments are only illustrative and various changes and modifications may be imparted thereto without departing from the scope of the invention which is limited solely by the appended claims.

What is claimed is:

1. A sheet conveying apparatus comprising:

a sheet conveyance path defining member that defines a curved path of conveyance of a sheet;

a reference position regulating member for regulating the lateral position of a sheet that is conveyed along the curved conveyance path;

conveying means for conveying a sheet along the curved conveyance path while urging the sheet in a direction to keep a side edge of the sheet in contact with said reference position regulating member; and a guide member comprising a step portion on said reference position regulating member that restricts the position of the side edge of the sheet in contact with said reference position regulating member in a direction of the thickness of the sheet while the sheet is conveyed along the curved conveyance path.

2. A sheet conveying apparatus according to claim 1, wherein said guide member is disposed adjacent said sheet conveyance path defining member.

3. A sheet conveying apparatus according to claim 1, wherein said conveying means comprises a rotary conveyor member having a peripheral surface positioned adjacent to said sheet conveyance path defining member.

4. A sheet conveying apparatus according to claim 3, wherein a gap is formed between said rotary conveyor member and said reference position regulating member.

5. A sheet conveying apparatus according to claim 4, wherein said guide member is disposed in the gap between said rotary conveyor member and said reference position regulating member.

6. A sheet conveying apparatus according to claim 5, wherein said guide member is disposed in contact with said reference position regulating member.

7. A sheet conveying apparatus according to claim 6, wherein said guide member is formed integrally with said reference position regulating member.

8. A sheet conveying apparatus according to claim 1, wherein said guide member is formed by plural step portions positioned to prevent a side edge of a sheet from buckling or curling into the gap.

9. A sheet conveying apparatus according to claim 7, wherein said guide member is fixed to said reference position regulating member.

10. A sheet conveying apparatus according to claim 1, wherein said conveying means comprises a skewed rotary member that urges a sheet into pressure contact with said reference position regulating member.

11. A sheet conveying apparatus comprising:

a rotary conveyor member for conveying a sheet;

a conveyance path defining member disposed opposite to an outer peripheral surface of said rotary conveyor member so as to define therebetween a curved conveyance path of a sheet conveyed along the outer peripheral surface of said rotary conveyor member;

a reference position regulating member for regulating the lateral position of a sheet when the sheet is conveyed by said rotary conveyor member;

a skewed rotary member in the curved conveyance path for urging a sheet conveyed by said rotary conveyor member in a direction such that a side edge of the sheet is pressed against said reference position regulating member; and a guide member comprising a step portion on said reference position regulating member that restricts movement of the side edge of the sheet pressed against said reference position regulating member in a direction of sheet thickness as the sheet is pressed against said reference position regulating member by said skewed rotary member.

12. A sheet conveying apparatus according to claim 11, wherein a gap is formed between said rotary conveyor member and said reference position regulating member.

13. A sheet conveying apparatus according to claim 12, wherein said guide member is disposed in the gap between said rotary conveyor member and said reference position regulating member.

14. A sheet conveying apparatus according to claim 13, wherein said guide member is disposed so as to fill the gap between said rotary conveyor member and said reference position regulating member.

15. A sheet conveying apparatus according to claim 14, wherein said guide member is formed integrally with said reference position regulating member.

16. A sheet conveying apparatus according to claim 15, wherein said guide member is formed by plural step portions positioned to prevent a side edge of a sheet from buckling or curling into the gap.

17. A sheet conveying apparatus according to claim 15, wherein said guide member is fixed to said reference position regulating member.

18. A sheet conveying apparatus comprising:

sheet stack storage means for storing a stack of sheets;

sheet feeding means for feeding sheets one by one from the stack in said sheet stack storage means;

a rotary conveyor member for conveying a sheet fed by said sheet feeding means;

a conveyance path defining member disposed opposite to an outer peripheral surface of said rotary conveyor member so as to define therebetween a curved conveyance path of a sheet conveyed along the outer peripheral surface of said rotary conveyor member;

a reference position regulating member for regulating the lateral position of a sheet when the sheet is conveyed by said rotary conveyor member;

a skewed rotary member in the curved conveyance path for urging a sheet conveyed by said rotary conveyor member in a direction such that a side edge of the sheet is pressed against said reference position regulating member; and a guide member comprising a step portion on said reference position regulating member that restricts movement of the side edge of the sheet in contact with said reference position regulating member in a direction of sheet thickness as the sheet is pressed against said reference position regulating member by said skewed rotary member;

said sheet feeding means, said rotary conveyor member and said skewed rotary member each pressing against only the lateral edge of the sheet regulated by said reference position regulating member.

19. A sheet conveying apparatus according to claim 18, further comprising a separation claw that cooperates with said sheet feeding means to allow only one sheet from the sheet stack in said sheet stack storage means to be separated, and contacts only the portion of the sheet adjacent to the lateral edge of the sheet regulated by said reference position regulating member.

20. A sheet conveying apparatus according to claim 18, wherein a gap is formed between said rotary conveyor member and said reference position regulating member.

21. A sheet conveying apparatus according to claim 20, wherein said guide member is disposed in the gap between said rotary conveyor member and said reference position regulating member.

22. A sheet conveying apparatus according to claim 21, wherein said guide member is disposed so as to fill the gap between said rotary conveyor member and said reference position regulating member.

23. A sheet conveying apparatus according to claim 22, wherein said guide member is formed integrally with said reference position regulating member.

24. A sheet conveying apparatus according to claim 23, wherein said guide member is formed by plural step portions positioned to prevent a side edge of a sheet from buckling or curling into the gap.

25. A sheet conveying apparatus according to claim 23, wherein said guide member is fixed to said reference position regulating member.

26. An image forming apparatus comprising:

a sheet conveyance path defining member that defines a curved path of conveyance of a sheet;

a reference position regulating member for regulating the lateral position of a sheet conveyed along the curved conveyance path;

conveying means for conveying a sheet along the curved conveyance path while urging the sheet in a direction to keep a side edge of the sheet in contact with said reference position regulating member;

image forming means for forming an image on a sheet that is being conveyed by said conveying means; and a guide member comprising a step portion on said reference position regulating member that restricts the position of the side edge of a sheet in contact with said reference position regulating member in the direction of the thickness of the sheet while the sheet is conveyed along the curved conveyance path.

27. An image forming apparatus comprising:

a rotary conveyor member for conveying a sheet;

a conveyance path defining member disposed opposite to an outer peripheral surface of said rotary conveyor member so as to define therebetween a curved conveyance path of a sheet conveyed along the outer peripheral surface of said rotary conveyor member;

a reference position regulating member for regulating the lateral position of a sheet when the sheet is conveyed by said rotary conveyor member;

a skewed rotary member in the curved conveyance path for urging a sheet conveyed by said rotary conveyor member in a direction such that a side edge of the sheet is pressed against said reference position regulating member;

image forming means for forming an image on a surface of a sheet that is being conveyed by said rotary conveyor member; and a guide member comprising a step portion on said reference position regulating member that restricts movement of a side edge of the sheet in contact with said reference position regulating member in a direction of sheet thickness as the sheet is pressed against said position regulating member by said skewed rotary member.

28. An image forming apparatus comprising:

sheet stack storage means for storing a stack of sheets;

sheet feeding means for feeding sheets one by one from the stack in said sheet stack storage means;

a rotary conveyor member for conveying a sheet fed by said sheet feeding means;

a conveyance path defining member disposed opposite to an outer peripheral surface of said rotary conveyor member so as to define therebetween a curved conveyance path of a sheet conveyed along the outer peripheral surface of said rotary conveyor member;

a reference position regulating member for regulating the lateral position of a sheet when the sheet is conveyed by said rotary conveyor member;

a skewed rotary member in the curved conveyance path for urging a sheet conveyed by said rotary conveyor member in a direction such that a side edge of the sheet is pressed against said reference position regulating member;

image forming means for forming an image on a sheet that is being conveyed by said rotary conveyor member; and a guide member comprising a step portion on said reference position regulating member that restricts movement of a side edge of the sheet in contact with said reference position regulating member in a direction of sheet thickness as the sheet is pressed against said reference position regulating member by said skewed rotary member;

said sheet feeding means, said rotary conveyor member and said skewed rotary member each pressing against only the lateral edge of the sheet regulated by said reference position regulating member.

29. A sheet conveying apparatus comprising:

a sheet conveyance path defining member that defines a curved path of conveyance of a sheet;

a reference position regulating member for regulating the lateral position of a sheet that is conveyed along the curved conveyance path;

conveying means for conveying a sheet along the curved conveyance path while urging the sheet in a direction to keep a side edge of the sheet in contact with said reference position regulating member; and a guide member that restricts the position of a side edge of a sheet in a direction of the thickness of the sheet while the sheet is conveyed along the curved conveyance path, wherein said guide member is disposed in the gap between said rotary conveyor member and said reference position regulating member.

30. A sheet conveying apparatus according to claim 29, wherein said guide member is formed integrally with said reference position regulating member.

31. A sheet conveying apparatus according to claim 30, wherein said guide member comprises a step portion that protrudes from a position regulating surface of said reference position regulating member.

32. A sheet conveying apparatus according to claim 31, wherein said guide member is formed by plural step portions positioned to prevent a side edge of a sheet from buckling or curling into the gap.

33. A sheet conveying apparatus according to claim 30, wherein said guide member is fixed to said reference position regulating member.

34. A sheet conveying apparatus according to claim 29, further comprising image forming means for forming an image on the sheet conveyed by said conveying means.

* * * * *

UNITED STATES PATENT AND TRADEMARK OFFICE

CERTIFICATE OF CORRECTION

PATENT NO. : 5,562,280
DATED : October 8, 1996
INVENTOR(S) : TAKESHI NIMURA, ET AL.

It is certified that error appears in the above-indentified patent and that said Letters Patent is hereby corrected as shown below:

Column 1,
line 31, "is" should read --are--; and
line 63, "he" should read --the--.

Column 2,
line 32, "a" (first occurrence) should read --an--.

Column 5,
line 23, "recording" should read --a recording--.

Signed and Sealed this
Fourth Day of March, 1997

Bruce Lehman

BRUCE LEHMAN
*Commissioner of Patents and Trademarks*

*Attest:*

*Attesting Officer*